United States Patent [19]

Madland et al.

[11] 4,162,591

[45] Jul. 31, 1979

[54] DOOR DRIVER

[75] Inventors: Thorvald Madland, Arlington Heights; Thomas C. Soddy, Downers Grove, both of Ill.

[73] Assignee: The Youngstown Steel Door Company, Cleveland, Ohio

[21] Appl. No.: 763,853

[22] Filed: Jan. 31, 1977

[51] Int. Cl.[2] ..... E05C 3/36; E05F 11/54

[52] U.S. Cl. ..... 49/277; 292/DIG. 32; 292/DIG. 46; 292/341.17; 292/DIG. 72

[58] Field of Search ..... 292/DIG. 32, DIG. 46, 292/199, 341.17; 49/350, 220, 449; 49/277

[56] References Cited

U.S. PATENT DOCUMENTS

| | | | |
|---|---|---|---|
| 1,659,029 | 2/1928 | Julien | 292/DIG. 32 |
| 2,177,325 | 10/1939 | Madland | 292/DIG. 32 |
| 2,772,901 | 12/1956 | Roethel | 49/350 X |

*Primary Examiner*—Richard E. Moore
*Attorney, Agent, or Firm*—John H. Mulholland

[57] ABSTRACT

A door driver is provided on a railway house car for moving a railway car door between a locking position and a sliding position. The door driver includes a lever which is rotatably mounted on a structural member of the railway car. The door driver further includes a plurality of drivingly interconnected drive members, one of which is a driving member and another of which a driven member. The lever is drivingly connected to the driving member. The drive members have a plurality of gear teeth thereon and are rotatably mounted on the railway car with the gear teeth of at least one other drive member. When a force is exerted on the driving member, the driving member transmits that force to the driven member so the force capable of being exerted by the driven member is greater than the force exerted on the driving member. The door driver also includes means for connecting the railway car door to the driven member so that upon movement of the lever, the railway car door is urged between the sliding position and the locking position with a force that is greater than the force exerted on the lever.

1 Claim, 5 Drawing Figures

DOOR DRIVER

BACKGROUND OF THE INVENTION

The present invention relates to a door driver and more particularly to a door driver which moves a railway house car door between a locking position and a sliding position.

When a railway car is in use, cargo is loaded into the railway car by opening the railway car door and moving the cargo to be transported into the car either manually or by mechanical means, such as a lift truck. Once the cargo is loaded into the railway car, the railway car door is closed and locked in that position. When the railway car reaches its destination, the railway car door is unlocked and opened and the cargo is removed from the railway car. In some cases, the cargo is palletized and must necessarily be handled by lift trucks to reduce the labor for loading and unloading operations, considerable damage has been caused to doors and the railway car side parts adjacent to the doorway. For example, the lift hooks of the lift trucks have inadvertently caused such damage by hitting the front stops on the car frame and the front edges of the sliding railway car door. After such damage has been caused, it is extremely difficult to open or close the door manually since there is extreme binding between the front stops on the railway car and the front edges of the railway car door. In the field, a lift truck has been used to move the door into a locking position by exerting substantial force on the door. This operation in turn causes additional damage.

In order to alleviate this problem various modifications to the door engaging members, both on the door and the structural frame of the railway car, have been made. One such modification is moving the door engaging member away from the door opening so that the lift trucks and their pallets do not hit these members. These solutions have reduced the frequency of damage but have not completely eliminated the problem so that it still exists at a lesser frequency.

Present door locking mechanisms have starters and closers that move the door out of or into the lock position over a small distance. One such prior art mechanism is disclosed in Madland, U.S. Pat. No. 3,279,839. Madland discloses a lever which is capable of exerting a force on the railway car door which urges the railway car door towards a locking position. This design develops a minimum mechanical advantage under optimum conditions. In most cases of deformation of car side parts or doors, this mechanical advantage is insufficient to overcome the binding forces with a force manually applied to the lever. Thus, the use of a lift truck or a come-long device is required.

As is apparent from the above, the primary reason for using a door driver is to exert a force to move the door into and out of a locking position which force is sufficient to overcome binding forces between the railway car body or frame and the door. It is particularly desirable that this force is exerted by manual means and not by the use of any auxiliary equipment which is expensive, time consuming and if not properly designed may create additional damage to the door or railway car frame. It is also desirable that the door driver be capable of moving the railway car door a substantial distance under such greater force. When a lock mechanism is utilized, it is also desirable to provide a door driver which is capable of slightly moving the door when it is in the lock position so that the lock may be easily released.

SUMMARY OF THE INVENTION

The present invention provides a door driver for moving a railway car door from a sliding position to a locking position with a force which is substantially greater than a manual force exerted on the door driver to thereby overcome extreme binding between the railway car door and the railway car door frame. The door driver of the present invention is capable of exerting such a multiplied force on the railway car door over a substantial distance so that the door may be moved between the sliding and locking positions even when the door or the railway car structural members are substantially damaged.

It should be understood from the outset that in its broadest sense, the door driver of the present invention may be used for either double or single door cars or cars with any number of doors. When used in conjunction with single car doors, the door driver is secured to a support member of the railway car adjacent to the leading edge of the sliding door when it is in a completely closed or locking position.

The door driver of the present invention provides a lever which is rotatably mounted on the support member of the car adjacent to the leading edge of the railway car door when it is in a locking position. The door driver of the present invention also provides a plurality of drivingly interconnected drive members including a driving member and a driven member. The drive members have a plurality of gear teeth thereon and are rotatably mounted on the railway car support member with the gear teeth of the drive members in meshing engagement with the gear teeth of at least one other drive member. The level is drivingly connected to the driving member so that when a force is exerted thereon, the driven member is driven through the gear train of the drive members so that the force exerted by the driven member is substantially greater than the force exerted on the lever.

The door driver also includes means for connecting the railway car door to the driven member so that when a force is exerted on the lever, a force is exerted on the railway car door that is substantially greater than the force exerted on the lever. The mechanical advantage realized by such a door driver of the present invention is sufficient to overcome extreme binding between the door and the railway car member against which it is seated. The sliding door driver of the present invention is capable of exerting such a substantial force over a sufficient distance to move the door even when the door or railway car has been extremely damaged. The door driver of the present invention also allows the sliding door to be moved when it is in the locked position so that the lock mechanism may be easily released.

It should also be understood that the sliding door of the present invention is capable of being utilized in conjunction with standard lock and sealing means without requiring any special adaptation thereof or any other special lock and sealing design.

Accordingly, it is an object of the present invention to provide a door driver for moving a railway car door between a locking position and a sliding position by exerting a force on the railway car door to so move the door with a force sufficient to overcome extreme binding between the door and the member to which it is sealed.

It is yet another object of the present invention to provide a door driver on a railway car for moving a railway car door between a locking position and a sliding position in which the force exerted on the railway car door is substantially greater than the manual force exerted on the door driver.

It is still a further object of the present invention to provide a door driver on a railway car for moving a railway car door between a locking position and a sliding position in which the sliding position of the door is a substantial distance from the locking position of the door.

It is still a further object of the present invention to provide a door driver on a railway car for moving a railway car door between a locking position and a sliding position without causing any additional damage to the railway car or its door.

It is still another object of the present invention to provide a door driver on a railway car for moving a railway car door between a locking position and a sliding position which is capable of moving the door when in the locking position to allow the door lock to be readily and easily released.

Other objects and advantages of the present invention will appear during the course of the following description and with reference to the annexed drawings in which like parts are designated by like numerals throughout the same.

DETAILED DESCRIPTION OF THE INVENTION

Figure 1:
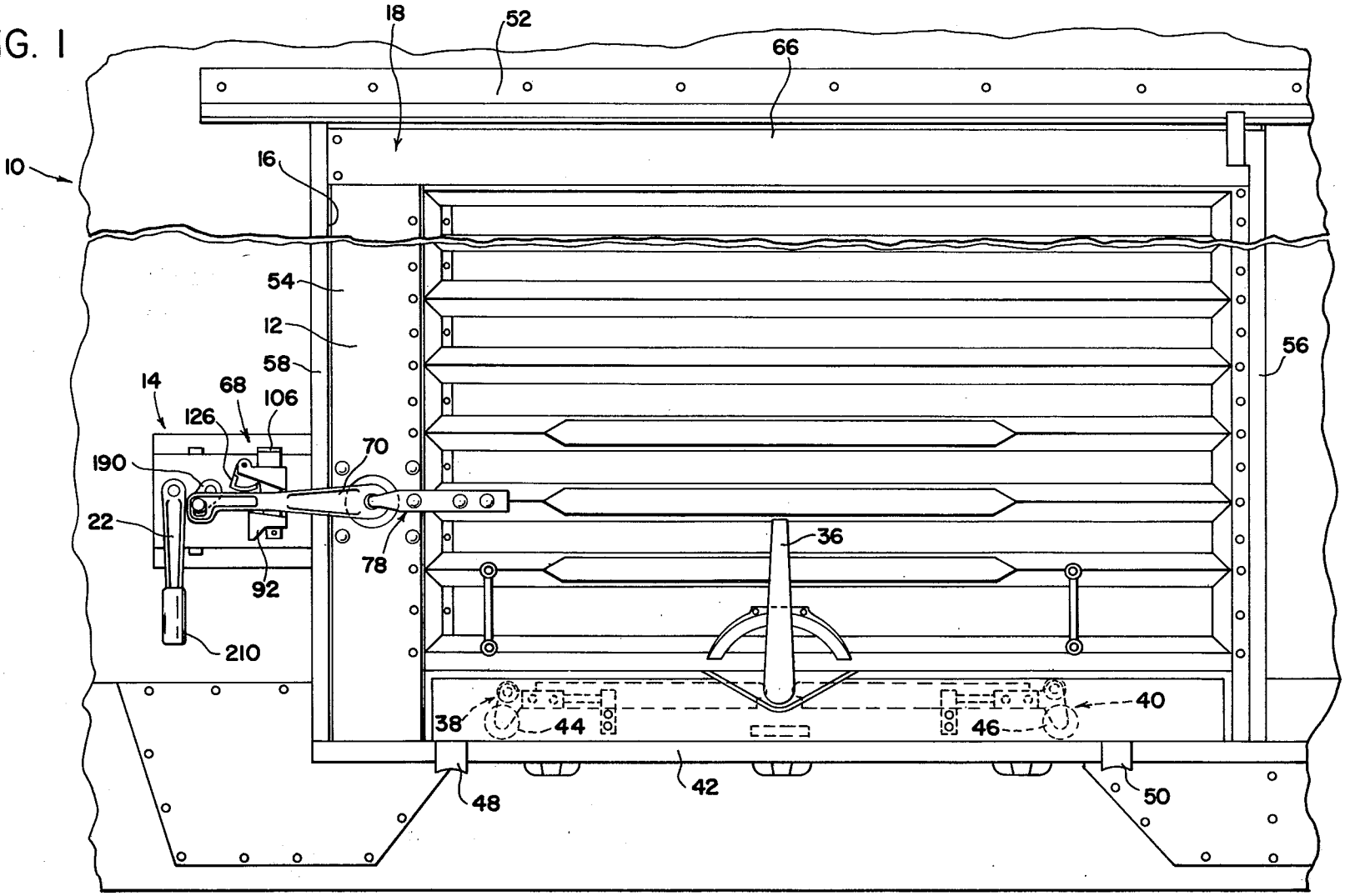
FIG. 1 is a front elevational view showing a door driver of the present invention applied to a single door construction of a railway car with the door in a locked position.

In the drawings, a single door house car 10 is illustrated as having a sliding door 12 with a novel door driver 14 thereon, generally designated by the numeral 14 as seen in FIG. 1. The railway car 10 has a door opening 16. The door driver 14 of the present invention is provided for moving the railway car door 12 between a closed position 18 in which the door may be locked as seen in FIG. 1 and another position in which the door is unlocked and slightly opened generally indicated at 20 in FIG. 3. For purposes of description either of the positions 18 and 20 may be described as a first or a second position. In the unlocked and slightly opened position 20, when the door driver 14 is disengaged from the railway car door 12, the door 12 may be moved along the side of the railway car 10 to open the door opening 16 completely so that cargo may be loaded into or unloaded from the railway car 10.

As described above, damage may occur to the door 12 during the loading and unloading process. Consequently, the door driver 14 is provided to urge the door 12 from the unlocked and slightly open position 20 to the completely closed or locked position 18 with a force sufficient to overcome any binding forces created by damaged portions of the door or other parts of the railway cars as will be hereinafter described.

Figure 2:
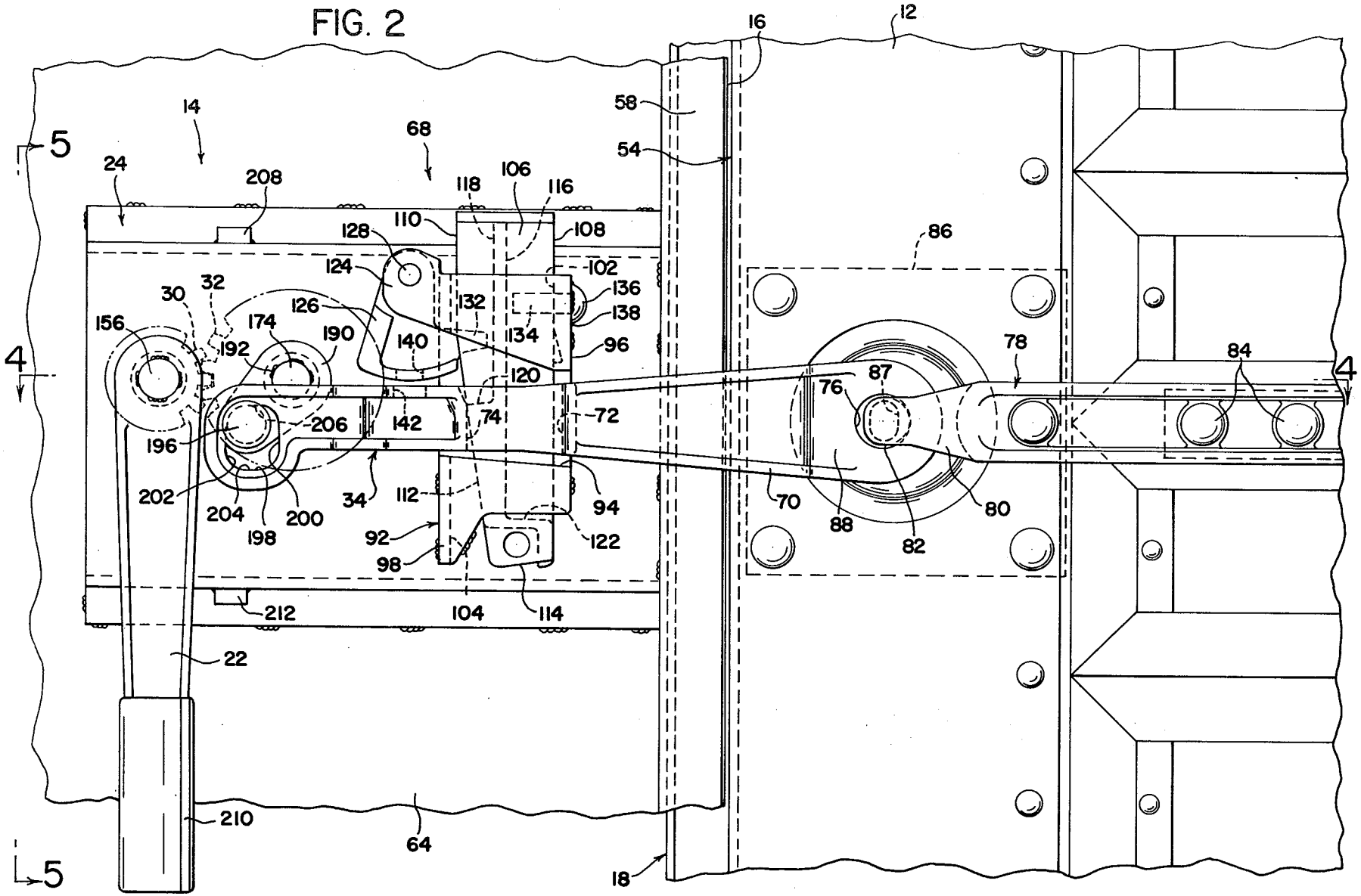
FIG. 2 is a detailed elevational view of the door driver shown in FIG. 1 with the door in a locked position.

The door driver 14 of the present invention includes a lever 22 rotatably mounted on a hat-shaped structural member 24 adjacent to the opening 16 as best seen in FIG. 2. The door driver 14 also includes a plurality of drivingly interconnected force multiplying members or drive member 26, 28 which include a driving member 26 and a driven member 28. The driving member 26 is drivingly connected to the lever 22.

Figure 3:
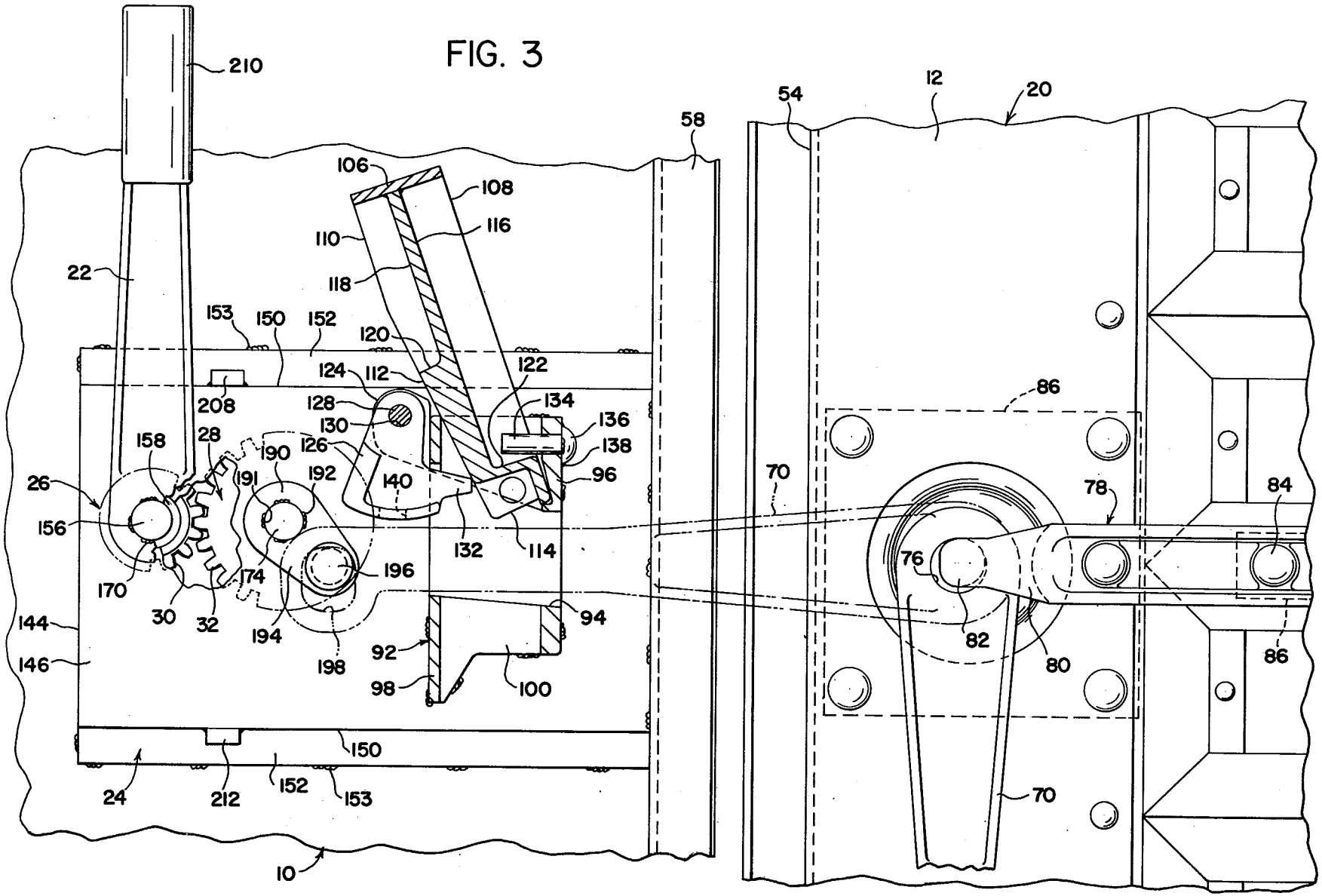
FIG. 3 is a detailed elevational view of the door driver of FIG. 1 with the railway car door in an unlocked and slightly opened position.

The drive members 26, 28 have a plurality of gear teeth 30, 32, respectively thereon. The drive members 26, 28 are rotatably mounted on the railway car 10 with the gear teeth 30, 32 respectively in meshing engagement with each other. As will be hereinafter more fully described, the drive members 26, 28 transmit a force exerted on the driving member 26 to the driven member 28 so that the force exerted by the driven member is greater than the force exerted on the driving member. The door driver 14 also includes means, generally indicated at 34, for connecting the door 12 to the driven member 28. Upon movement of the lever 22, the door is urged between the unlocked and slightly opened position 20, as seen in FIG. 3, and the closed position 18, as seen in FIG. 1, with a force that is greater than the force exerted on the lever and tramsmitted through the drive members 26 and 28 and connecting means 34 to the door 12.

The door 12 is of the type generally known in the art as a lift door and includes a handle 36 and corresponding lifting mechanisms 38 and 40 operated thereby in a manner known to those skilled in the art. The lifting mechanisms 38 and 40 engage a track 42 for selective movement thereon by means of rollers 44 and 46 respectively. The general structure of the door 12 includes bottom retainers 48 and 50 in engagement with the track 42 and a top retainer structure 52 co-operates with other conventional structural members to hold the door in aligned position for sliding movement upon actuation of the lift mechanism by the lever 36. The door 12 has a forward or front edge 54 and a rear edge 56. When the door is moved into a closed position 18 against a front stop 58, the rear edge 56 and the front edge 54 make a weather tight seal with the door opening 16.

Figure 4:
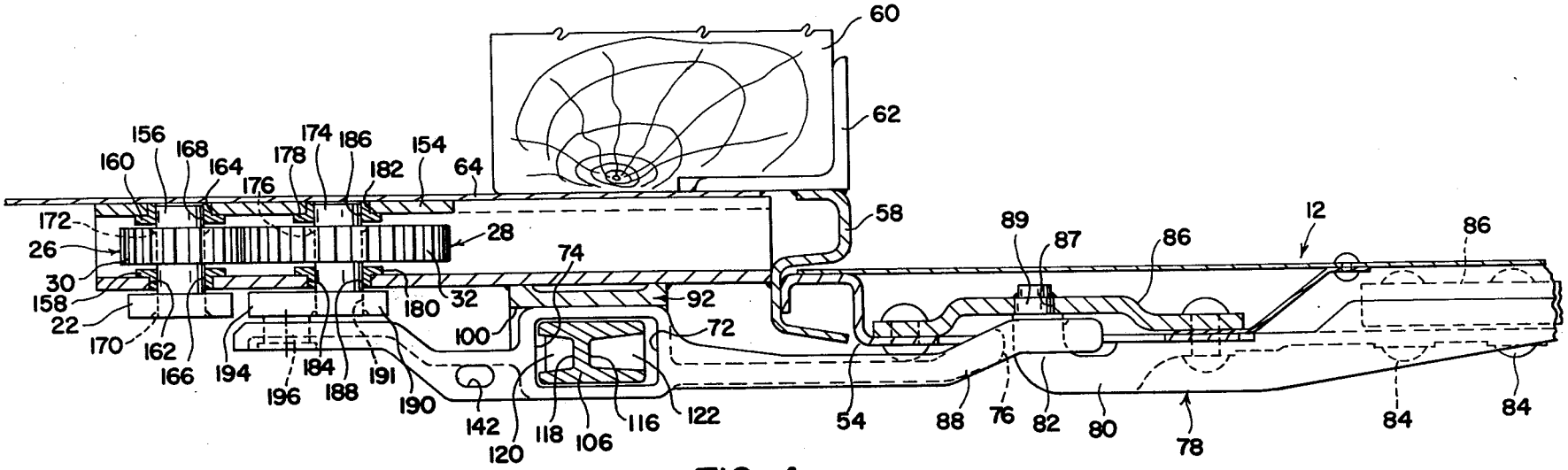
FIG. 4 is a cross-sectional view of the portion of the door driver shown in FIG. 2 and taken along lines 4—4 thereof.

The forward or front stop 58 is mounted on a front post or fixed structure 60 having a reinforcing portion 62, as best seen in FIG. 4, together with metal sheathing 64 by an conventional means in a manner well known to those skilled in the art such as welding.

A post protective member or strip co-operates with a rear weather strip in a known manner when the door 12 is in the closed position 18. Suitable top edge structure 66 and weather guards are provided and these members co-operate with the top retainer 52 and an inside header for holding the door in aligned position on the track 42 just outside of the threshold plate on the floor of the railway car 10. The details of construction of the sliding door 12 and surrounding structure, as described, are by way of environment and may be varied as will be readily recognizable to those skilled in the art. As previously mentioned, for instance, the fixed structure defined by the front stop 58 and front post 60 may be functionally replaced by a secured auxiliary door of a double door car. Accordingly, the door 12 represents either a single or the main door of a double door car or of any other multiple door car.

A locking means, generally designated by the numeral 68, is provided to selectively lock and secure the door 12 in the closed position and may be of any design well known to those skilled in the art. An elongated hasp member 70 is provided and has a vertical opening 72 therethrough as best seen in FIG. 2. The opening 72 has three substantially straight sidewall portions and a slightly curved or tapered forwardmost inner wall portion 74. The hasp 70 is pivotally mounted on the door 12 by means of a bore 76 in one end of the hasp which co-operates with a hasp fastener 78. The hasp fastener 78 is a plate-like member having a forwardly projecting tongue 80 which forms an eyelet or closed curved bar portion at its end 82 which is of slightly smaller cross-sectional diameter than the diameter of the hasp bore 76. Accordingly, the hasp 70 is relatively loosely supported on the fastener 78 for vertical and lateral pivotal movement.

The hasp fastener 78 has a plurality of apertures through which rivets or other conventional fasteners 84 pass to secure the fasteners 78 to the panels of the door 12, as best seen in FIG. 4. Appropriate hasp fastener retaining plates and fillers 86 are interposed between the hasp fastener 78 and the surface of the door 12 to distribute the stresses and insure that the forces exerted on the hasp fastener by the hasp 70 will not damage the door 12 and pull the fastener from its seat. One of the hasp fastener retaining plates 86 has an aperture 87 therein for receiving the end portion 89 of the hasp fastener 78 and is secured therein by any conventional means such as welding.

It will be readily recognized that other means of securing the hasp fastener 78 to the door 12 may be utilized, such as welding or bolting. The hasp 70 is of sufficient length that it projects from the end 82 of the hasp fastener 78 past the forward edge 54 of the door 12 and past the stop 58, which is fixedly attached to the forward post 60, as best seen in FIG. 4. The hasp opening 72 is located at a point intermediate the ends of the hasp 70 such as when the hasp is horizontally extended and the door closed, the opening 72 is in a position directly opposite the post 60. The hasp 70 has an appropriate contour including an S-shaped bend 88 to provide a clearance around the outermost projecting portion of the edge 54 of the door 12, and the rivets holding the paneling of the door to the edge 54. Because of a relatively loose fit between the bore 76 and the holding member 82, disposed therein, the hasp 70 is free to pivot on a horizontal plane outwardly from the door a sufficient amount to insure clearance of these portions of the structure.

Mounted on a hat-shaped member 24 which is secured to the marginal portions of the sheathing 64 by any conventional means, such as welding, is a locking member 92, as best seen in FIGS. 2 and 3. The locking member 92 has a generally channel-shaped slot 94 extending transversely across the locking member in a substantially horizontal direction to define an upper bracket portion 96 and a lower bracket portion 98 extending from the base 100. In the upper bracket portion 96 is a vertically oriented opening 102 and in the lower bracket portion 98 is a vertically oriented opening 104. The openings 102 and 104 are in substantially vertical alignment to provide a substantially vertical passage for receiving a locking pin 106.

The locking pin 106 comprises an elongated body with opposite sides 108 and 110. The side 110 has a tapered portion 112 which converges toward the straight side 108 to form a narrow end 114 on the pin 106. Along the straight side 108 of the pin 106 over a substantial portion of its length is a groove or recess portion 116 having a generally U-shaped cross section. On the opposite side 110, a similar shaped, somewhat shorter recess or slot 118 is provided with its bottom wall 120 a substantially greater distance from the end 114 of the pin than is the bottom wall 122 of the recess 116. The relative lengths and positions of the opposite recesses 120 and 122 are important in the operation of the locking means 68 as will be further described herein.

The locking pin 106 is of such dimension as to permit its receipt in the openings 102 and 104 of the upper and lower brackets 96 and 98 respectively, and the channel 94 is adapted to receive the intermediate portion of the hasp 70 with its vertical opening 72 in substantial alignment with the openings 102 and 104. The hasp 70 is placed in this position by movement of the hasp laterally toward the locking member 92 through pivotal movement of the hasp on the hasp fastener bar 82 located in the enlarged, loosely fitting bore 76 at the end of the hasp. The tapered surface 74 in the bore 72 of the hasp is adapted to co-operate with the tapered portion 112 on the pin 106 such that when the pin is in position and the vertical passage formed by the bores 102, 104 and 72, the pin 106 holds the hasp snuggly and firmly in place.

Pivotally secured to a lug 124 on the upper bracket portion 96 of the locking member 92 is a sealing cam 126 mounted on pivot pin 128 in the aperture 130. The sealing cam 126 has a projecting nose portion 132 for co-operation with the shorter recess 110 of the pin 106 when the pin 106 is in the locking position. When the sealing cam 126 is thus received in the recess 118, it will be seen that the portion 132, because of its obstruction of the end 120 and the recess 118 will positively prevent upward movement of the pin out of the locking position, and accordingly, it is required that sealing cam 126 be manually pivoted before the locking pin 106 may be lifted out of the openings 102, 104 to the point where the hasp may be removed from the channel 94.

Also mounted on the upper bracket portion 96 with the channel 102 is a fixed portion 134 which is in the form of a rivet having a head 136 and a shank which extends through the wall of the upper bracket 96 into the passage 102. The fixed rivet or pin 134 is secured as by weld 138 so that it is securely mounted therein. The pin 134 co-operates with the recess 116 of locking pin 106 to limit its upward motion by causing the abutment to interfere with the bottom 122 of the recess 116 to prevent movement of the locking pin 106 out of the vertical opening 102 of the upper bracket portion 96. The dimension of the recess or slot 116 of the pin 106 is such that taken with the position of the projection 134 and the opening 102 of the upper bracket 96, the pin is permitted to move upward to a point which clears the pin end 114 of the hasp opening 72 to permit movement of the hasp 70 out of the channel 94. By means of co-operation of the projection 134 and the recess 116, the locking pin 106 may not become lost since it cannot be removed entirely from the upper bracket of the locking member 92.

Accordingly, the sealing cam 126, when in the recess 118, limits movement of the pin 106 out of the openings 104 and 72 of the lower bracket 98 and the hasp 70 respectively, and the fixed projection 134 limits movement of the pin 106 out of the opening 102 of the upper bracket 96, when the sealing cam 126 is not in the recess 118.

As is well known to those skilled in the railway house car art, it is often necessary in the transport of goods by rail, to seal the house cars with security seals to insure that the lading has not been tampered with enroute. The sealing means contemplated in the instant door lock utilizes an opening 140 in the lower face of the seal cam 126 and an opening 142 in the adjacent top portion of the hasp 70. The position of the openings 140 and 142 on their respective elements is such that when the locking pin 106 is in a locking position, the seal opening 140 is in direct alignment with the opening 142 and the security seal may be passed through these openings to make it impossible to move the sealing cam 126 without destroying the seal. Accordingly, the railway car door 12 may not be opened without damaging the seal and unauthorized tampering with the lading will be avoided.

The door driver 14 is provided to move the door 12 between the unlocked and slightly open position or sliding position 20 to the completely closed or locking position 18 in which locking position the locking means 68 may be utilized to lock the door 12 in the locking position 18. As shown in FIG. 3, when the door 12 is in the unlocked and slightly open position 20, the front edge 54 of the door 12 is spaced from and adjacent to the front stop 58. Consequently, any damage to the front edge 54 or front stop 58 which may be caused by the loading or unloading of cargo on the railway car 10 will not prohibit the door 12 from moving to the unlocked and slightly opened position 20. It should be understood that when the door 12 is in the sliding position 20, it is free to move laterally along the car 10 so that the door opening 16 is completely opened and cargo may be loaded and unloaded.

Figure 5:
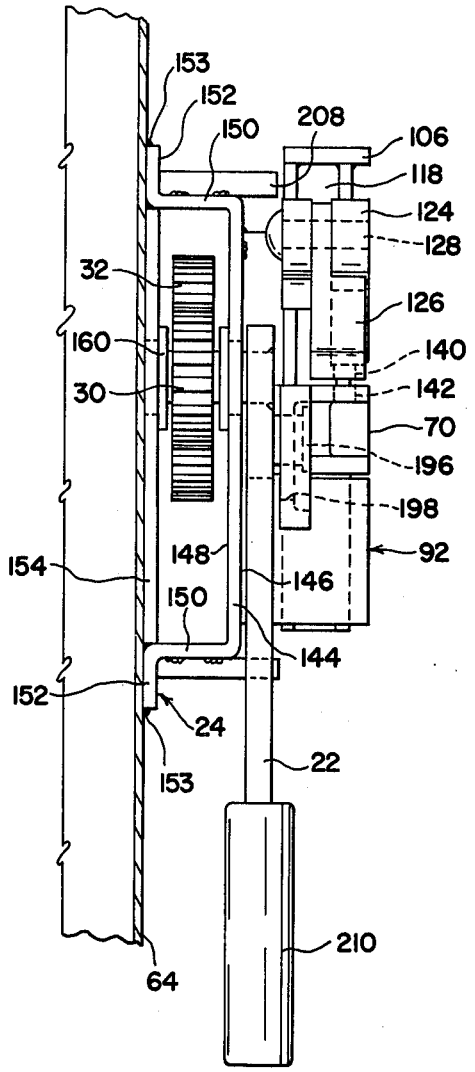
FIG. 5 is a cross-sectional view of the portion of the door driver shown in FIG. 2 and taken along lines 5—5 thereof.

The door driver 14 includes a lever 22 which is rotatably mounted on a hat-shaped structural member 24 as seen in FIG. 5. The hat-shaped member 24 has an outer portion 114 with outer and inner surfaces 146, 148. The hat-shaped member 24 also has extending portions 150 which extend from the outer portion 144 and terminate in the securing portions 152 of the hat-shaped member. The hat-shaped member 24 is secured to the railway car sheathing 64 by any conventional means such as welding, as generally indicated at 153. Extending between the extending portions 150 of the hat-shaped member 24 is a reinforcing plate 154 which is also secured to the sheathing 64 by any conventional means such as welding.

In order to rotatably mount the lever 22 in the hat-shaped member 24 and reinforcing plate 154, a shaft 156 is provided. The shaft 156 is rotatably received by the bearings 158 and 160. The bearing 158 is received in an aperture 162 in the hat-shaped member 24 and the bearing 160 is secured in an aperture 164 in the reinforcing plate 154. The bearings 158 and 160 have journal surfaces generally indicated at 166 and 168 respectively and rotatably support the shaft 156 therein. The lever 22 is secured to one end of the shaft 156 by any conventional means such as the welds 170.

The door driver 14 also includes a plurality of drivingly interconnected force multiplying or drive members 26, 28. The driving member 26 has an opening therein to receive the shaft 156. The driving member 26 is secured to the shaft 156 by any conventional means, such as the welds 172, as best seen in FIGS. 3, 4 and 5. The driving member 26 has a plurality of gear teeth 30 thereon which lie in a predetermined gear pitch radius which gear pitch radius has an axis about the rotational axis of the shaft 156. It should be understood that the driving member 26 shown in the drawings is a conventional gear having conventional gear teeth 30 thereon but may be of any geometric configuration with any type of gear teeth that is desirable in the adaptation of the door driver 14 to any particular railway car environment.

The driven member 28 has a plurality of gear teeth 32 about its outer circumference which are centered around a predetermined gear pitch radius. In the particular embodiment described herein, the gear pitch radius of the driving member 26 is less than the gear pitch radius of the driven member 28 in order to gain a greater mechanical advantage as will hereinafter be described. It is important to understand though, that other drive members may be provided and interposed between driving member 26 and driven member 28 to create a similar gear reduction or even greater gear reduction and in such case the gear pitch radius of the driving member 26 need not be less than the gear pitch radius of the driven member 28. The important consideration is that there is a force multiplier effect by the drive members so that the force capable of being exerted by the driven member 28 is greater than the force exerted on the driving member 26.

The driven member 28 is secured to a shaft 174 by any conventional means such as the weld 176. Bearings 178 and 180 are received in openings 182, 184 in the reinforcing plate 154 and hat-shaped member 24 respectively. The bearings 178, 180 have bearing surfaces 186 and 188 respectively therein for rotatably receiving the shaft 174 therein. The apertures 182 and 184 are in alignment with each other so that the bearings 178 and 180 rotatably receive the shaft 174 in a position so that the gear teeth 30, 32 of the driving member 26 and driven member 28 respectively are in constant meshing engagement throughout rotation thereof.

As seen in FIG. 4, a crank member 190 has an aperture 191 therein which receives one end of the shaft 174 therein. As shown in FIG. 3, the crank 190 is secured to the shaft 174 by any conventional means, such as the welds, indicated at 192. The crank 190 has a lever arm portion 194 terminating in an extending stud portion 196. The hasp 70 has an aperture 198 as will hereinafter be more fully described which co-operates with the stud 196. When the crank 190 is driven by the driven member 28, the crank and consequently the outwardly extending stud 196 will be rotated to move the hasp 70 in a manner as will hereinafter be more fully described.

It should be also understood that it is within the contemplation of this invention that the driving and driven members 26 and 28 respectively may be replaced by any number of drive members with gear teeth thereon or linkage systems or any combination of the above which will multiply the force exerted on the driving member so that the force capable of being exerted by the driven member 28 is greater than the force exerted on the driving member 26.

After cargo is loaded into the railway car 10, the door 12 is moved laterally along the railway car to the sliding position 20 indicated in FIG. 3 to partially close the opening 16 through which the cargo was loaded. In this position, the hasp 70 is rotated from the position indicated by solid lines in FIG. 3 to the position indicated by phantom lines in FIG. 3 so that the hasp is received in the channel 94 of the locking member 92. In this position, the stud 196 is received by the aperture 198 in the hasp 70. As seen in FIG. 2, the aperture 198 is generally retangular in configuration with two opposite spaced lateral portions 200 and 202 and with horizontal portions 204, 206. The space between the lateral portions 200 and 202 is greater than the diameter of the stud 196 so as to allow the sliding position 20 in which the hasp engages the stud 196 to be variable. It should be understood that the sliding position 20 may also vary depending upon the amount of damage done to the various components of the railway cars described hereinabove.

When the hasp 70 is located in the position indicated in the phantom lines, the lever 22 is in an upright position as indicated in FIG. 3. A stop 208 is secured to the hat-shaped member 24 and extends outwardly of the outer surface 146 of the hat-shaped member so as to contact the lever 22 and thereby prohibit over travel or over rotation of the lever 22.

In this position, as indicated in FIG. 3, the crank 190 is positioned so that its vertical movement about the rotational axis of the shaft 174 is equal when the door is in the sliding position 20, indicated in FIG. 3, and the closed position 18, indicated in FIGS. 1 and 2. This maximizes the amount of force exerted on the hasp 70 as well known to those skilled in the art. It should be understood that other positions of the crank may be more particularly suited if a greater force is necessary at one particular point to overcome extreme binding since the maximum force exerted on the hasp will exist when a line between the rotational axis of the shaft 174 and rotational center of the stud 196 is at a right angle with respect to a line between the rotational center of the stud 196 and the rotational center of the end portion 82 of the hasp fastener 78.

In order to move the door 12 from the sliding position 20 to the locking position 18, a force is manually exerted by an operator on the handle 210 of the lever 22. Due to the substantial length of the lever 22, the manually exerted force is multiplied so that a force which is a multiple of the force exerted on the handle 210 is exerted on the driving member 26. This force is transmitted from the driving member 26 to the driven member 28 by the gear teeth 30, 32 respectively.

Since the pitch radius of the gear teeth 30 is less than the pitch radius of the gear teeth 32, the force exerted on the driven member 28 is a multiple of the force exerted on the driving member 26 and thereby a force which is a substantial multiple of the manual force exerted on the handle 210 of the lever 22 is exerted on the shaft 174. This multiplied force is exerted on the hasp 70 by means of the stud 196 co-operating with the lateral wall 202 of the hasp 70. The spaced horizontal portions 204, 206 of the opening 198 in the hasp 70 are spaced apart from each other a sufficient distance to compensate for the vertical movement of the stud 196 of the lever 206. Thus, a minimum vertical component force is exerted on the hasp 70 when it is used to move the door in either direction between the sliding position 20 and the closed position 18.

It has been found that a force equal to twelve times the force manually exerted on the lever 22 may be exerted on the hasp 70 and consequently the door 12 with the door driver 14. It should be understood that even greater multiples of the manual force may be exerted on the door 12 by changing the pitch radiuses or adding additional drive members with gear teeth theron. It should also be understood that many other gears and linkages may be used in conjunction with the driving and driven members 26, 28 or the driving and driven members 26, 28 may be replaced with a linkage system or any other combination thereof to create a substantially multiplied force on the hasp 70 as described above.

Accordingly, by rotating the lever 22 the door 12 is moved towards the locking position 18 and even if there is substantial damage to the front edge 54 or front stop 58, a sufficient force may be manually exerted to overcome these extreme binding forces to move the door 12 to the locking position 18. As this manual force is exerted on the lever 22, the lever is rotated to the position shown in FIG. 2 and excessive over travel is prohibited by the stop 212 secured to the lateral portion 150 of the hat-shaped member 24. The stop member 121 extends from the outer surface 146 of the hat-shaped member 24 a sufficient distance to stop the lever 22.

In the closed position 18, as shown in FIG. 2, the front edge 54 is sealed against the front stop 58 so that the opening 16 on the railway car door is completely closed. When the door 12 is in the locking position 18, the locking means 68 may be operated to lock and seal the door in the position 18 so that the railway car may be transported. Accordingly, the locking pin 106 is firmly fixed in the passageway formed by the upper bracket opening 102, the hasp opening 72 and the lower bracket opening 104. The sealing cam 126 is then rotated into a locking position and sealed as described above.

When the railway car 10 has reached its destination and it is desirable to remove the cargo from the railway car, the seal described above is broken and a sealing cam 126 is manually moved out of position to allow the locking pin 106 to be readily removed therefrom. In some cases the locking pin is jammed or locked by some slight movement of the railway car door 12 and accordingly the lever 22 must be manually rotated to allow the pin 106 to be loosened and removed. This is a further advantageous feature of the present invention.

After the pin 106 is removed, the lever 22 is rotated from the position shown in FIG. 2 to the position shown in FIG. 3 to thereby forcibly overcome any binding forces exerted between the railway car members 54, 58. The door 12 is then moved to a sliding position 20 as shown in FIG. 3 by rotation of the lever 22. It should be understood that the door driver 14 of the present invention operates in a similar manner between both positions 18, 20 of the door 12 with the exception that the parts are rotated in opposite directions. The hasp is then moved to its position shown in solid lines in FIG. 3 and the railway car door 12 is free to move laterally along the side of the car so that the opening 16 therein is open and the cargo may be removed from the railway car.

We claim:

1. A door driver on a railway house car having a door opening for moving a door between a first and a second position comprising:

a structural member adjacent said opening;

a hat-shaped member and a reinforcing member secured to said structural member;

a lever rotatably mounted on said structural member adjacent said opening;

a plurality of drivingly interconnected drive members in addition to said lever and operatively connected thereto including a pinion fixed to rotate with said lever to drive at least one other gear member which, in turn, is operatively connected to a crank means to cause rotation thereof;

a hasp means selectively drivingly interconnected to said crank means;

said hasp means being mounted on said door for motion in both a plane parallel to the face of the door and a plane vertical to the face of the door to permit selective interconnection with said crank means;

and, means to permit said hasp means to be selectively locked in said selective interconnection with said crank means thereby to selectively maintain said door in a closed and locked condition.

* * * * *

UNITED STATES PATENT OFFICE

CERTIFICATE OF CORRECTION

PATENT NO. : 4,162,591

DATED : July 31, 1979

INVENTOR(S) : Thorvald Madland and Thomas C. Soddy

It is certified that error appears in the above-identified patent and that said Letters Patent are hereby corrected as shown below:

Column 12, line 3, delete the word "vertical" and insert therefor the word --perpendicular--

Signed and Sealed this

*First* Day of *January 1980*

[SEAL]

*Attest:*

SIDNEY A. DIAMOND

*Attesting Officer*

*Commissioner of Patents and Trademarks*